US007311643B2

(12) United States Patent
Sheeks et al.

(10) Patent No.: US 7,311,643 B2
(45) Date of Patent: Dec. 25, 2007

(54) PORTABLE, ERGONOMIC, UPPER LIMB AND SHOULDER ROTATOR EXERCISE APPARATUS WITH PATIENT ASSIST, MUSCULAR ENERGY MEASUREMENT METHOD

(76) Inventors: Oliver P. Sheeks, 316 River Run La., Flippin, AR (US) 72634; Sharon R. Sheeks, 316 River Run La., Flippin, AR (US) 72634

( * ) Notice: Subject to any disclaimer, the term of this patent is extended or adjusted under 35 U.S.C. 154(b) by 0 days.

(21) Appl. No.: 11/488,285

(22) Filed: Jul. 17, 2006

(65) Prior Publication Data

US 2007/0219049 A1 Sep. 20, 2007

(51) Int. Cl.
*A63B 26/00* (2006.01)

(52) U.S. Cl. ..... 482/142; 482/140

(58) Field of Classification Search ..... 482/142, 482/148

See application file for complete search history.

(56) References Cited

U.S. PATENT DOCUMENTS 3,732,962 A * 5/1973 Hall ..... 194/238
5,139,471 A * 8/1992 Dornberger ..... 482/79
6,837,838 B2 * 1/2005 List ..... 482/147

* cited by examiner

*Primary Examiner*—Lori Amerson

(57) ABSTRACT

An exercise board sized to the patient's abdominal area provides for maximum lateral range extension of the shoulder rotator and limb musculoskeletal system. A ferrous loaded exercise disk on top of a flat surface sheet is magnetically coupled to permanent magnets housed below in a laterally free space to establish a magnetically induced lateral frictional resistance against the patient's lateral force on the disk anywhere on the plane of the surface sheet. An incline exercise apparatus is formed by combining the board with an incline stand and a rope, pulley and pull ring, allowing a patient's good limb to assist in rehabilitating the acutely impaired limb, as from stroke, shoulder rotator damage, or surgery. Circuitous indicia paths, some with obstacles for the disk, provide a method for the determination the patient's range performance and energy expended.

13 Claims, 4 Drawing Sheets

$$F = (W\cos\phi \times f_1) \pm (W\sin\phi) + (Q \times f_2)$$

$$E = F \times D$$

PORTABLE, ERGONOMIC, UPPER LIMB AND SHOULDER ROTATOR EXERCISE APPARATUS WITH PATIENT ASSIST, MUSCULAR ENERGY MEASUREMENT METHOD

CROSS-REFERENCE TO RELATED APPLICATIONS

NA

STATEMENT REGARDING FEDERALLY SPONSORED RESEARCH OR DEVELOPMENT

NA

REFERENCE TO SEQUENCE LISTING

NA

BACKGROUND OF THE INVENTION

A. Field of the Invention

The present invention relates to the rehabilitation of acutely impaired upper limbs and shoulders of patients recovering from stroke, accident, and post surgical trauma. More particularly, the invention relates to an ergonometric system of exercise which maximizes the range of motion of the treatment and also provides a method for the measurement of energy of performance of the upper limb and shoulder musculoskeletal system. The invention opens new options in the field of patient challenged treatment for prescription by the therapist, which are a) variable resistive lateral restraint and b) patient assisted therapy whereby the good brain/good limb is utilized to help reconnect the communication network of the recovering brain/recovering limb in rope/pulley assisted climbing over obstacles on an incline plane.

B. Description of the Background Art

Acute rehabilitation facilities are in need of apparatus which more effectively provide for patient recovery by the exercise of upper limb and shoulder muscles and joints. Physical therapists modalities are presently limited to the utilization of dead weight lifts, spring and pulley resistive devices and simple table top slide equipment for patient exercise routines. The practitioner may manually assist the patient to extend muscles to the desired mobility range not allowed by presently available exercise equipment. Ergometers which measure the amount of work done by muscles over a mobility range are limited to linear or straight line practice. The present invention overcomes these limitations and allows exercise with work/energy measurements over a complex and circuitous range of motion. Further, the present invention maximizes the use of patient challenged and patient assisted therapy.

In view of the foregoing considerations, the present inventors conceived of the presently disclosed exercise apparatus and energy measuring method and system with ergonometric interface with the patient, thereby providing a more universal range of exercise for upper limb muscles and joints.

OBJECTS OF THE INVENTION

An object of the present invention is to provide a portable upper limb and shoulder exercise board apparatus which includes a generally polygonal shape but with one edge recessed inward providing an ergonomic interface, sized and configured to encircle the patient's lower abdomen, thereby maximizing the physical range of motion for rehabilitation of these musculoskeletal areas.

Another aspect of the invention is to provide a portable upper limb and shoulder exercise board which includes a slide disk, with included ferrous slug, with magnetically induced, variable, frictional drag over the board's full range of motion for rehabilitation purposes.

Another object of the invention is to provide an exercise board which includes a generally polygonal shape and is composed of a thin transparent top sheet covering a hollowed out free lateral slide space for permanent magnets which are confined within the boundary ring on the lateral sides and by a bottom close out sheet. Magnets are free to be attracted to and move with said slide disk residing on the top on the board, thereby causing magnetically induced frictional resistance force against slide disk motion anywhere on the board; thereby providing for a versatile resistance exercise program for the musculoskeletal system.

Another object of the invention is to provide a portable upper limb and shoulder exercise board with a method of both measuring and varying the amount of energy expended by the patient in moving the slide disk along prescribed indicia tracks, or paths, during exercise and also yielding knowledge of day to day performance improvements by the patient. The apparatus' associated frictional resistance force relationships are analytically established and may be calibrated for measurement of energy of motion as Force× Distance traveled.

Another object of the invention is to provide a portable upper limb and shoulder incline exercise board facilitated by a companion stand configured for securing the board at selectable frontal elevation angles.

Another object of the invention is to provide a rope, pulley and pull ring system in combination with the incline exercise board, thereby providing a means for the patient's good brain and good limb to physically assist the affected limb (and affected brain) in traversing the path of therapy in the plane of the incline exercise board.

Another object of the invention is to provide a challenge course of movement by placing bumps along a prescribed path on the board's face. These raised bumps are utilized as either challenge obstacles or rest stops along the incline plane. The bumps may be humorous or challenging in design, as smiley faces.

Various other objects and advantages of the present invention, and its most novel features, will become apparent to those skilled in the art by perusing the accompanying specification, drawings and claims.

It is understood that although the invention disclosed herein is fully capable of achieving the objects and providing the advantages describe, the characteristics of the invention described herein are merely illustrative of the preferred embodiments. Accordingly, we do not intend that the scope of our exclusive rights and privileges in the invention be limited to details of the invention described. We do intend that equivalents, adaptations and modifications of the invention reasonably inferable from the description contained herein be included within the scope of the invention as defined by the appended claims.

SUMMARY OF THE INVENTION

Briefly stated, the present invention contemplates a portable exercise apparatus with ergonomic abdominal fitting features and an energy measurement method; which exercise apparatus has a flat surface on which an exercise disk, loaded with ferrous material, is slidably forced laterally against a variable frictional resistance which is induced by a downward magnetic coupling of the disk with vertically polarized permanent magnets on the underside of the board's thin, transparent top sheet; said magnets are identically pulled upward by the same magnetic coupling but, with different, but co-directional, frictional resistance and with freedom to slide laterally, with resistance, within a free air space bounded by an outer peripheral ring and a bottom close out sheet. Movement of the disk by the patient therefore facilitates a method, or means, of providing measurable limb and shoulder physical exercise with disk motion along indicia paths as prescribed by the practitioner. This allow monitoring of energy and a daily measurement of relative improvement performance of the patient. Magnetic strength may be varied by the substitution or addition or subtraction of magnets with different strengths as the patient's strength changes. A high frictional resistance is desired, which is facilitated by the choice of plastic for both the disk and slide surfaces. By prior calibration of slide force, and by knowledge of the accumulative path length along indicia lines, total energy expended may be simply determined. The patent provides the relationship of Energy=Force×Distance where Force is a complex value of the disk weight and magnetically induced friction of both the top and bottom of the top sheet acting upon to oppose motion of both the disk and the magnet. A companion incline stand is shown which facilitates the choosing of variable positions of elevation angles of the board with respect to the patient. A rope, pulley and pull ring system is shown in combination with the incline stand and exercise board, whereby the pulley is attached to the upward extreme of the inclined board, thereby allowing for patient assisted therapy in "climbing" over obstacles along a prescribed path.

BRIEF DESCRIPTION OF THE DRAWINGS

FIG. 2 thereby shows the ferrous slug imbedded into the bottom of the slide disk and also shows an attracted magnet in a free air space within the board assembly; an access hole in the bottom close out sheet allows exchanging of magnets. The magnetic attraction upon the disk thereby causes frictional drag on both the disk and magnet parallel to the board's top sheet. FIG. 1 and FIG. 2 both reveal a three layer board; the top surface is transparent; the middle layer is a hollowed out entrapment, or ring, forming a free air space for magnet travel, the bottom layer is the lower close out; in practice the middle and bottom layers may be combined.

DETAILED DESCRIPTION OF THE INVENTION

Figure 2:
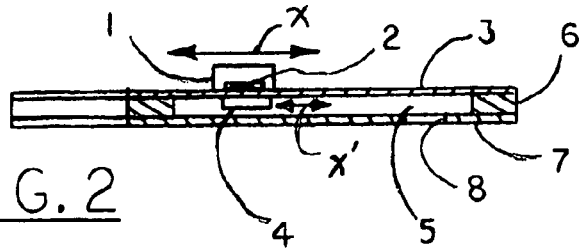
FIG. 2 is a transverse sectional view of the exercise board of FIG. 1, taken in the direction indicated by line 2-2 in FIG. 1.
Figure 1:
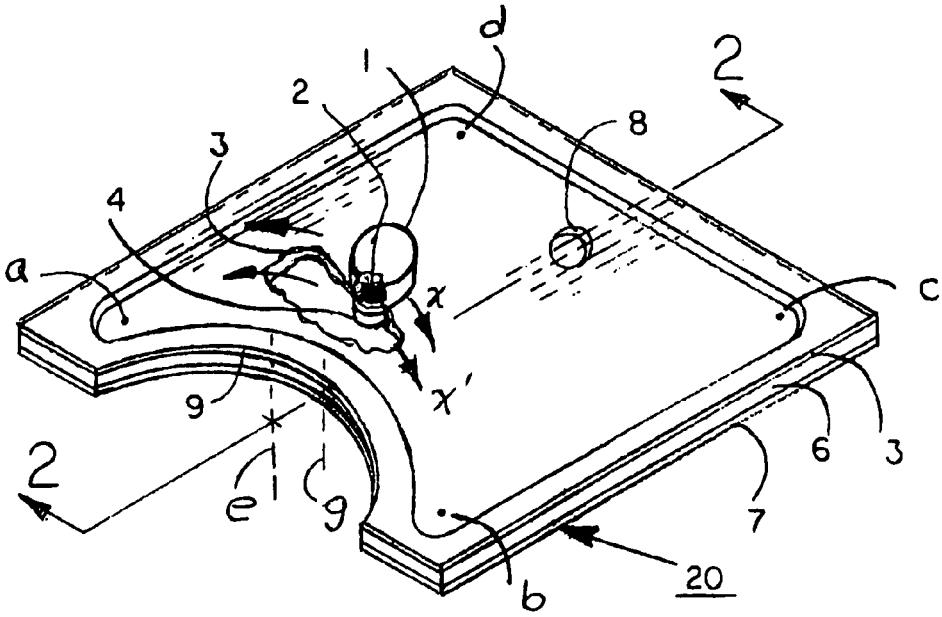
FIG. 1 is a perspective view of a portable upper limb and shoulder exercise apparatus according to the present invention, showing a flat top surface upon which a disk with included ferrous slug may be moved by a patient to any position bounded by field points a, b, c, and d; the patient being ergonomically positioned with backbone generally at line e and with abdomen, belly, against the apparatus' semicircular cutout and touching at the line g. In this position, the patient's left shoulder rotator would be positioned generally above point a so that the patient's left hand may grasp the disk at one musculoskeletal extreme and move it to all points around the board including the opposite musculoskeletal extreme at point b. A cut away view shows disk, embedded ferrous slug, top sheet, and attractive magnet, direction vectors x and x' are parallel indicating that the magnet follows the disk's motion.

Referring first to FIGS. 1 & 2, a basic embodiment of an ergonomically shaped, portable upper limb and shoulder exercise board 20 according to the present invention may be seen to include a flat surface top slide sheet 3 upon which a patient may slide a magnetically restricted slide disk 1 thereby performing an exercise. The magnetic restriction is induced because of clamping friction on both the top and lower sides of the slide sheet 3 acting upon the slide disk's ferrous insert 2 and also upon the magnet 4 as they are forced along the sheet 3 by the patient in a common vector x and x'. Magnet 4 follows slide disk 1 anywhere within free air space 5 as bounded by a hollowed out middle layer, or ring, 6 and bottom close out sheet 7. Bottom close out sheet 7 also contains an access hole 8 used for the purpose of exchanging magnets of different strengths, as may be prescribed, to vary the patient's required force to move the disk 1. The present invention ergonomically facilitates maximum stretch range of a patient by the incorporation of a semicircular cutout 9 whereby the patient's belly is positioned to touch line g and the shoulder rotator is positioned generally above point a so that the exercise disk 1 may be moved from extreme reach point a to extreme reach point b, a critical exercise for both stroke and shoulder rotator recovery. Exercise is also accomplished by movement of disk 1 (and magnet 4) around on the full surface of sheet 3, bounded by peripheral points a, b, c, and d. A calibrated drag force/energy method, shown later, facilitates determination of the energy expended in dragging the disk a known distance around the periphery.

Figure 4:
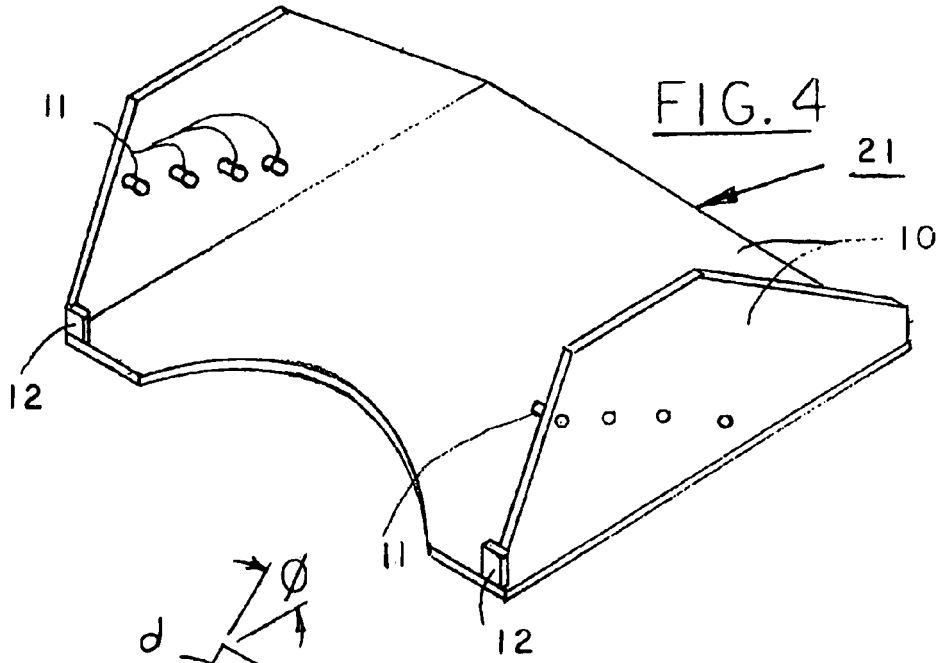
FIG. 4 shows with greater clarity the mounting fixture.
Figure 3:
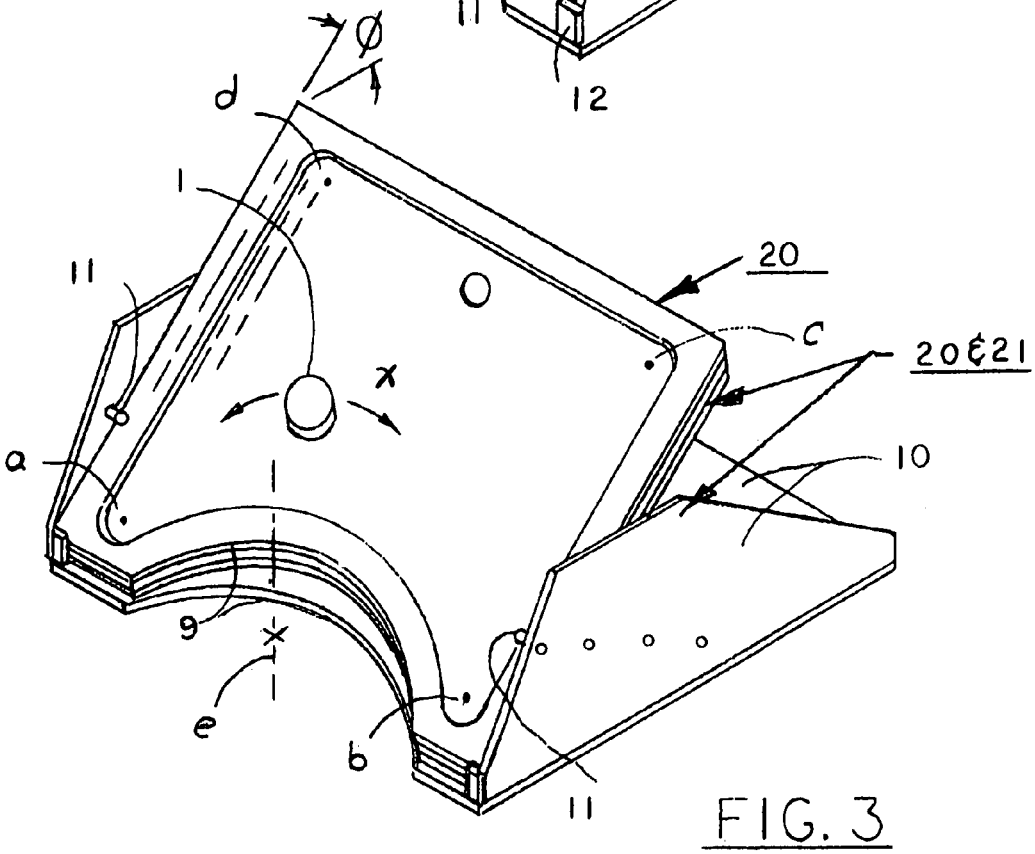
FIG. 3 reveals an assembly of the exercise board of FIGS. 1 & 2 and a mounting fixture; the fixture has multiple pegs for positioning the inserted board at desirable elevation angles with respect to the base of the fixture. Stops are provided which secure the lower edge of the board.

Referring to FIGS. 3 & 4, a portable upper limb and shoulder exercise board 20, in combination with stand 21 comprise a wider range of exercise angles while maintaining the ergonomic feature 9 of the single horizontal board also shown in stand 21. Stand 21 is comprised of a bottom board and two vertical side boards, each containing a multiplicity of holding pegs 11 for the purpose of elevating and securing the exercise board 20. Board stops 12 secure the lower end of the board 20. Exercise angle, Ø, is selectable in desired increments, typically at, but not limited to, 0, 15, 30, 45, and 60 degrees.

Figure 5:
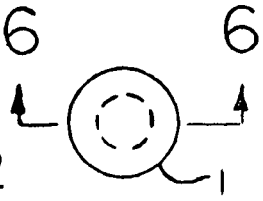
FIG. 5 shows a perspective view of the disk.
Figure 7:
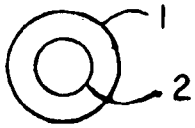
FIG. 7 is a bottom view of the disk of FIG. 6.

Referring to FIGS. 5 and 7, the top and bottom views of slide disk 1 reveal embedded ferrous slug 2.

Figure 6:
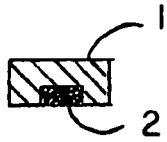
FIG. 6 shows a transverse sectional view of the disk of FIG. 5 and reveals an embedded ferrous slug.

Referring to FIG. 6, a transverse sectional view of the slide disk 1 further details the inserted ferrous slug 6.

Figure 8:
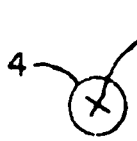
FIG. 8 is a top view of the board's entrapped magnet showing the polar magnetization direction of flux to be normal to the cylinder's ends.
Figure 9:
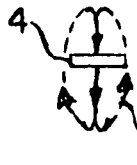
FIG. 9 is a side view of FIG. 8 also showing the field flux lines for Q.

Referring to FIGS. 8 and 9; the top and side views, respectively, of permanent magnet 4, show the lines of flux, Q, with their poles normal to the ends of the cylindrical body.

Figure 10:
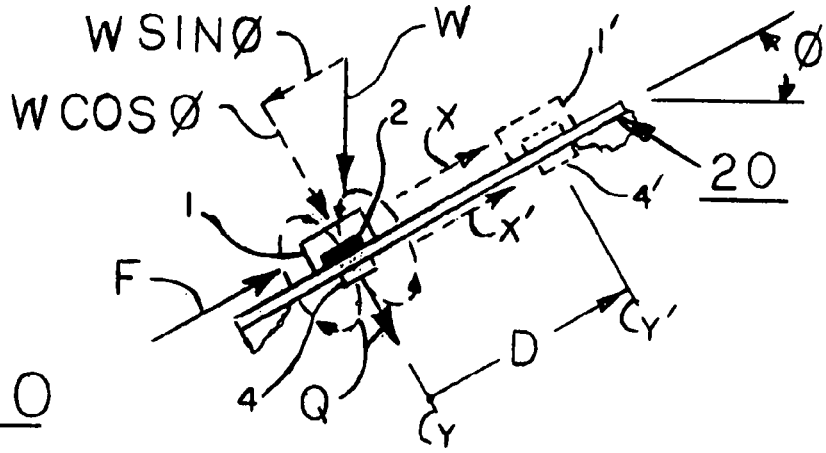
FIG. 10 is a schematic vector diagram showing, resolution of frictional, magnetic, and gravitational forces reacting against the patient's hand input force, F, as the disk is moved parallel to and along the board's upper surface. Energy, E is the product of force, F, and distance of movement, D. The complex function of E is derived later in the detailed description of the invention.

Referring to FIG. 10, the patient inputs force F to move slide disk 1, with included ferrous insert 2, across the face of the board 20 in the vector direction x; the magnet 4 follows in vector direction x'; both disk and magnet move from position y toward y' at an elevation angle Ø. The energy required to perform this function is E, or force F times distance D. The schematic and resulting force F reveal the equation for F is comprised of weight W, sinØ & cosØ terms, slide disk & board coefficient of friction f, and magnet & board (underside) coefficient f', elevation angle Ø, and magnetic clamping force, Q. An example would be: F=0.75 pounds, distance D=93.3 inches around the peripheral indicia path; therefore energy expended is 0.75×93.3=70 inch pounds, or 1.9 calories, per trip around the board's periphery, a-b-c-d of FIG. 1.

Figure 11:
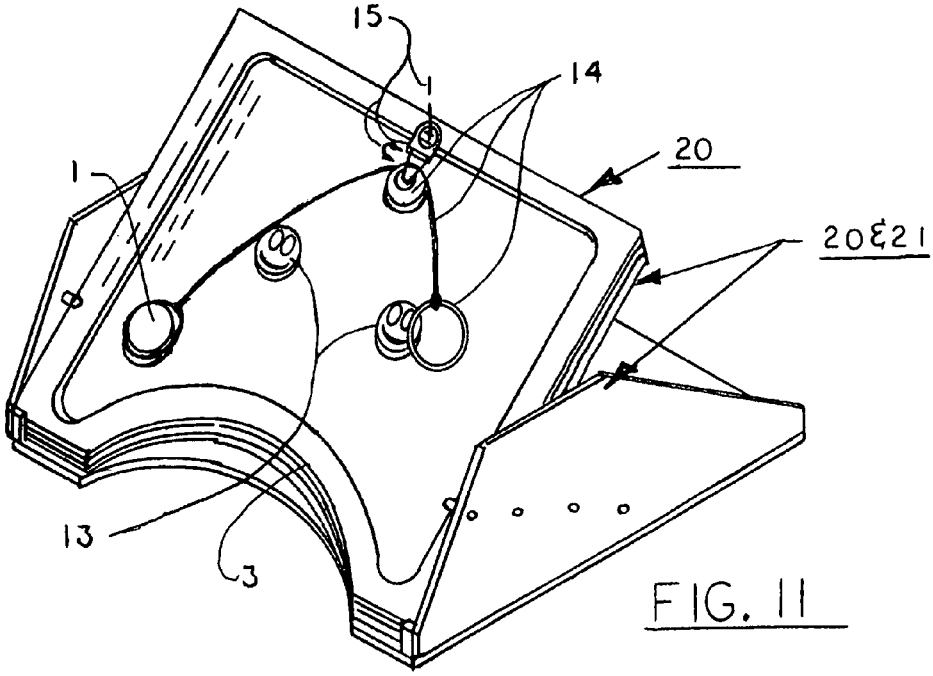
FIG. 11 shows the basic exercise board of FIGS. 1 and 3 with the additional features of a rope and pulley system and "climbing" obstacles which facilitate patient assisted therapy.

Referring to FIG. 11, the said exercise board 20 of FIGS. 1, 2 and 3 is shown with obstacles, or bumps, 13 affixed to top sheet 3.

Referring to FIG. 11, the said exercise board of FIGS. 1, 2, and 3 and slide disk 1 are shown fitted with rope and pulley and pull ring system 14 affixed to exercise board 20 at attachment point 15. The system 14 may be reversed right to left, or back, as allowed by swivel integral with the pulley at attach point 15. The patient grasps the rope and pulley's pull ring with the hand of the good limb to assist with recovering limb's movement.

What we claim is:

1. An upper limb and shoulder exercise board device having, in combination: a polygonal shaped assemblage consisting of three flat sheets, a thin top sheet, a middle sheet and a bottom close out sheet, with said sheets' frontal edges forming an ergonomic fit with the patient's abdomen; upon which said top sheet'surface an exercise disk is slidably moved in universally lateral directed paths by force of hand; which force is equal to an opposing, magnetically induced frictional force of resistance by attracted, internal permanent magnets sliding along the under side of the said top sheet; said directed paths being generally along circuitous, lateral indicia paths; the said assemblage further consisting of internal bounding features which laterally contain the said flat permanent magnets between the said top sheet and a bottom sheet, said magnets being constrained at the extremes of lateral travel by boarders formed by the inward edges of a middle sheet.

2. The exercise board of claim 1, wherein said polygonal shaped assemblage consisting of three flat sheets wherein said ergonomic fit is sized and configured to encircle the patient lower abdomen by an inwardly receding edge.

3. The exercise board of claim 1, wherein said thin top sheet is transparent, nonferrous, and upon which said disk may be slidably forced in a lateral direction.

4. The exercise board of claim 1 wherein said exercise disk contains a ferrous metal, or slug, which attracts said internal permanent magnets along in a free lateral slide space provided by said internally bounding features.

5. The exercise board of claim 1 wherein said universally directed paths may be coincident with said circuitous indicia paths as prescribed, by a practitioner, either with markings along the upper surface of the said top sheet's surface or along the internal surface of the said bottom close out sheet; the latter being visible through the transparent top sheet; one special indicia consisting of a marked peripheral path identified as a path through the extreme range points.

6. The exercise board of claim 2 wherein one said inwardly receding edge is configured to establish at least a 180 degree lateral range of patient's limb motion by the positioning of the patient's shoulder rotator generally above the left/right side pockets of the board's design so that a patient's shoulder rotator is stretched rearward to an extreme position when the corresponding hand grasps the disk at that extreme position.

7. The exercise board of claim 1 wherein said internal permanent magnets are flat, cylindrical, permanent magnets which are polarized with lines of flux normal to their flat ends.

8. The exercise board of claim 3 wherein said thin top surface sheet is clear plastic with a generally high coefficient of slide friction (normally 0.24 or greater) with the disk and with the magnets.

9. The exercise board of claim 1 wherein said bottom close out sheet is configured with an access hole provided for the purpose of interchanging magnets of various strengths.

10. A method of measuring the expended energy of a workout by the patient, in inch pounds or calories according to claim 1 wherein determining the energy as the total distance a disk is moved around the said peripheral path length multiplied by the magnetically induced frictional resistive force imposed upon the disk; the energy of performance, E, is defined as set forth in this invention as F×D.

11. A companion incline stand, in combination with the upper limb and shoulder exercise device of claim 1, provides, by configuration, angular adjustments for varying the board's incline angle, Ø; and whereby a rope, pulley and pull ring apparatus is attached to said disk and wherein pulley is attached by swivel to the extreme upward center of the board for the purpose of either right or left hand assisted therapy.

12. A companion stand as in claim 11 wherein said angular adjustments are provide by pegs positioned appropriately into the vertical side walls of the said companion incline stand, thereby supporting the said device of claim 1 at desired angles.

13. An upper limb and exercise device of claim 11 is further comprised with a series of obstacles, or bumps, affixed to the said top sheet, wherein the patient is provided a set of diversionary challenges, or rest stops, as may be the case; the obstacles may consist of humorous designs, as smiley faces, to encourage and challenge the patient to complete the course.

* * * * *